US006952077B2

(12) United States Patent
Park et al.

(10) Patent No.: US 6,952,077 B2
(45) Date of Patent: Oct. 4, 2005

(54) ELECTRON GUN FOR CATHODE RAY TUBE

(75) Inventors: Duk-Sung Park, Suwon (KR); Yeong-Guon Won, Suwon (KR); Bong-Wook Jung, Seongnam (KR); Se-Ja-Chul Hwang, Suwon (KR)

(73) Assignee: Samsung SDI Co., Ltd., Suwon-si (KR)

( * ) Notice: Subject to any disclaimer, the term of this patent is extended or adjusted under 35 U.S.C. 154(b) by 141 days.

(21) Appl. No.: 10/143,882

(22) Filed: May 14, 2002

(65) Prior Publication Data

US 2002/0171351 A1 Nov. 21, 2002

(30) Foreign Application Priority Data

May 15, 2001 (KR) ..... 2001-26467

(51) Int. Cl.[7] ..... H01J 29/46; H01J 29/50

(52) U.S. Cl. ..... 313/414; 313/412; 313/413; 313/421; 313/417; 313/449; 313/456; 315/15

(58) Field of Search ..... 313/412–414, 313/421, 440, 442, 449, 451, 456; 315/15, 5, 38, 380

(56) References Cited

U.S. PATENT DOCUMENTS 3,932,786 A * 1/1976 Campbell ..... 315/3
5,668,448 A * 9/1997 Montie et al. ..... 315/382.1
6,133,685 A * 10/2000 Konda et al. ..... 313/456
6,509,680 B2 * 1/2003 Aarnink ..... 313/414
6,614,157 B2 * 9/2003 Matsuo et al. ..... 313/440
6,617,777 B2 * 9/2003 Taguchi et al. ..... 313/412
6,624,559 B2 * 9/2003 Suzuki et al. ..... 313/414

FOREIGN PATENT DOCUMENTS

JP 8-115684 5/1996
JP 11-162372 6/1999
JP 2003031154 A * 1/2003 ..... H01J/29/48

* cited by examiner

*Primary Examiner*—Nimeshkumar D. Patel
*Assistant Examiner*—Sikha Roy
(74) *Attorney, Agent, or Firm*—Robert E. Bushnell, Esq.

(57) ABSTRACT

An electron gun for a cathode ray tube includes a cathode for radiating electron beams, a scanning velocity modulation coil for synchronizing the electron beams with an image signal, a focus electrode having first and second sub-electrodes disposed with a gap through which a magnetic field generated by the scanning velocity modulation coil passes, a plurality of grid electrodes with the focus electrode for controlling the electron beams radiated from the cathode, a support for aligning and supporting the grid electrodes, and a shield electrode electrically connected to the first and second sub-electrodes to protect against infiltration of an outer electric field. The shield electrode includes plural intermediate electrodes disposed in the gap between the first and second sub-electrodes, and electrical connecting unit for electrically connecting the intermediate electrodes to the first and second sub-electrodes. The intermediate electrodes are spaced away from each other.

22 Claims, 3 Drawing Sheets

ELECTRON GUN FOR CATHODE RAY TUBE

CLAIM OF PRIORITY

This application makes reference to, incorporates the same herein, and claims all benefits accruing under 35 U.S.C. §119 from an application for ELECTRON GUN FOR CATHODE RAY TUBE earlier filed in the Korean Industrial Property Office on May 15, 2001 and there duly assigned Serial No. 2001-26467.

BACKGROUND OF THE INVENTION

1. Field of the Invention

The present invention relates to a cathode ray tube (CRT), and more particularly, to an electron gun for a CRT that can improve the efficiency of the magnetic field generated by a scanning velocity modulation (SVM) coil and effectively prevent the focus deterioration caused by an outer electric field.

2. Description of the Related Art

Generally, a CRT has a phosphor screen scanned by electron beams, a neck portion in which an electron gun for generating the electron beams is disposed, and a funnel portion for connecting the screen and the neck portion. Disposed around the neck portion is a deflection yoke for deflecting the electron beams generated by the electron gun. An SVM coil is also disposed around the neck portion to correspond to the electron gun.

The SVM coil is designed to improve the definition at borders of images by synchronizing the location of electron beams passing through electrodes of the electron gun with image signals. The SVM has two saddle coils facing each other and being interconnected in series. A brightness signal of the image signals is differentiated twice, and then input to the SVM coil.

A conventional electron gun used for a high definition projection CRT includes a cathode for radiating electrons, first to fifth grid electrodes for controlling the electrons radiated from the cathode, and a bead glass for supporting the grid electrodes. The grid electrodes are disposed inside the neck portion.

The first and second electrodes are formed as flat electrodes, and the third and fourth electrodes are formed as cylindrical electrodes. The fourth electrode is used as a focus electrode for focusing electron beams.

The SVM coil is disposed corresponding to the fourth electrode around the neck portion.

The cylindrical portion of the fourth electrode is located corresponding to the inner portion of the SVM coil, causing the magnetic field generated by the SVM coil to be blocked by the cylindrical portion of the fourth electrode and an eddy current to be generated on a metal surface of the cylindrical portion. This deteriorates the magnetic field efficiency affected on the electron beams, making it difficult to precisely control the location of the electron beams.

Since the location of the SVM coil is predetermined when designing the electron gun, it is difficult to displace the location of the SVM coil.

Accordingly, to improve the properties of the SVM coil, the number of coil turns should be increased or the amount of current should be increased. However, when increasing the number of coil turns, the size of the SVM is increased, and when increasing the current, the energy consumption is increased.

To solve the above-described problems, Japanese Laid-open Patent No. H8-115684 issued to Funakura for Electron Gun discloses an electron gun having two divided focus electrodes disposed having a gap (about 3 to 5 mm (millimeters)) there between so that the magnetic field generated in the SVM coil passes through the gap. As the magnetic field passes through the gap, the generation of the eddy current on the metal surface of the focus electrodes can be prevented, thereby improving the properties of the SVM coil.

However, an outer electric field (including an electric field generated by static electric fir charge accumulated on an inner wall of the neck portion) may be infiltrated through the gap, deteriorating the focusing operation of the focus electrode.

To solve this problem, the Japanese patent discloses, as another embodiment, an electron gun including two focus electrodes disposed facing each other with a gap between them. The electron gun further includes plural metal plates each having a thickness of about 0.2 to 0.5 mm (millimeter) attached to facing surfaces of the focus electrodes. The metal plates function as shield electrodes for preventing the eddy current by reducing the gap.

However, since plural metal plates are attached to each of the facing surfaces of the electrodes, the magnetic field generated by the SVM coil may be blocked by the plates, thereby generating the eddy current. In addition, since the gap between the metal plates cannot be defined having a sufficient distance, improvement of the properties of the SVM coil is limited.

To solve the above-described problems, Japanese Laid-open Patent No. H11-162372 to Nomura for Electron Gun discloses an electron gun having a focus electrode provided at its sidewall corresponding to the SVM coil with a slit perpendicular to the advancing direction of the electron beams so that the magnetic field generated by the SVM coil can pass through the slit.

The slit prevents the outer electric field from infiltrating as well as preventing the generation of the eddy current.

That is, since the magnetic field passes through the slit, the generation of the eddy current on the surface of the focus electrode is reduced, preventing the deterioration of the focusing property by the outer electric field. However, it is difficult to form the slit on the sidewall of the focus electrode, thereby increasing the manufacturing costs.

SUMMARY OF THE INVENTION

It is therefore an objective of the present invention to provide an electron gun that can is, prevent the deterioration of the focusing property while improving the efficiency of the magnetic field generated by the SVM coil.

It is another object to provide an electron gun that can prevent the deterioration of the focusing property while improving the efficiency of the magnetic field generated by the SVM coil and yet prevent the increase in manufacturing costs.

To achieve the above and other objectives, the present invention provides an electron gun for a cathode ray tube, including a cathode for radiating electron beams; a scanning velocity modulation coil for synchronizing the electron beams with an image signal; a focus electrode having first and second sub-electrodes disposed with a gap through which a magnetic field generated by the scanning velocity modulation coil passes; a plurality of grid electrodes with the focus electrode for controlling the electron beams radiated from the cathode; a support for aligning and supporting the grid electrodes; and a shield electrode electrically connected to the first and second sub-electrodes to protect from infiltration of an outer electric field, the shield electrode including plural intermediate electrodes disposed in the gap between the first and second sub-electrodes and electrical connecting means for electrically connecting the intermediate electrodes to the first and second sub-electrodes, the between electrodes being spaced away from each other.

Preferably, the spacing distance between the first and second electrodes is about 4 to 12 mm (millimeters), and each of the intermediate electrodes is formed of a nonmagnetic material and is disk-shaped having a thickness of about 0.5 to 1.0 mm (millimeter).

Preferably, the first sub-electrode has a length of more than 0.5 times the inner diameter of the first sub-electrode, and the disk-shaped intermediate electrodes have an identical thickness within a range of about 0.5 to 1.0 mm.

The disk-shaped intermediate electrodes may be fixed on the support at an identical distance within a range of about 0.5 to 1.0 mm.

The first sub-electrode may have a length of less than 0.5 times the inner diameter of the first sub-electrode.

Preferably, the thickness of the disk-shaped intermediate electrodes proximal to the first sub-electrode on the basis of the midpoint of the gap is designed to be greater than that of the disk-shaped intermediate electrodes proximal to the second sub-electrode.

Alternatively, the gap between the disk-shaped intermediate electrodes proximal to the first sub-electrode is designed to be less than the gap between the disk-shaped intermediate electrodes proximal to the second sub-electrode.

According to another embodiment of the present invention, each of the intermediate electrodes is cylinder-shaped.

Preferably, the first sub-electrode has a length of more than 0.5 times the inner diameter of the first sub-electrode, and the cylinder-shaped intermediate electrodes are fixed on the support at an identical distance within a range of about 0.5 to 1.0 mm.

Alternatively, the first sub-electrode has a length of less than 0.5 times the inner diameter of the first sub-electrode.

Further, preferably the gap between the cylinder-shaped intermediate electrodes proximal to the first sub-electrode is designed to be less than the gap between the cylinder-shaped intermediate electrodes proximal to the second sub-electrode.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
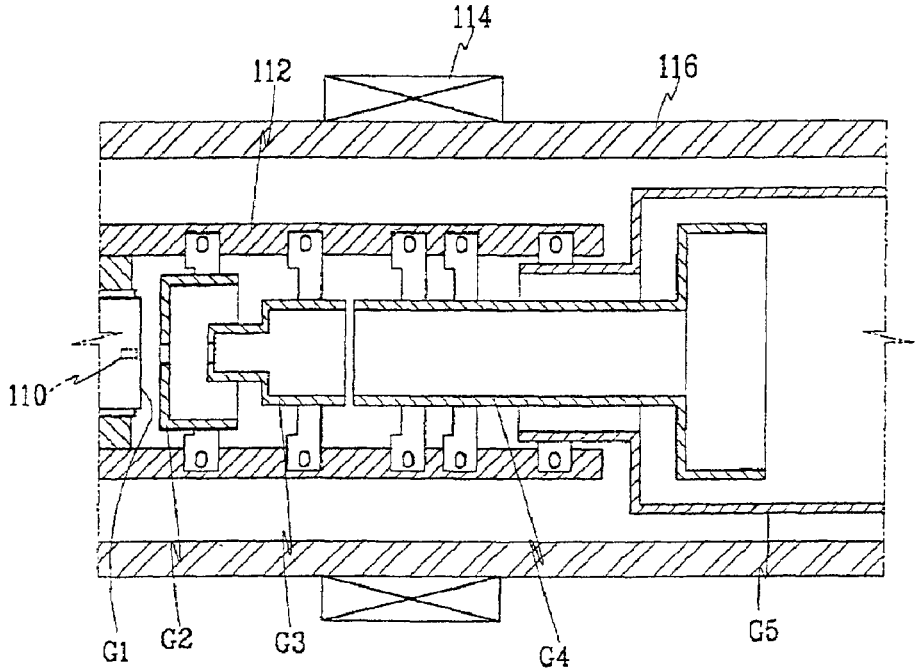
FIG. 1 (RELATED ART)
FIG. 1 is a view illustrating a conventional electron gun of a CRT.

Preferred embodiments of the present invention will be described in detail with reference to the accompanying drawings. FIG. 1 shows a conventional electron gun. The electron gun depicted in FIG. 1 is one used for a high definition projection CRT. The electron gun includes a cathode 110 for radiating electrons, first to fifth grid electrodes G1–G5 for controlling the electrons radiated from the cathode 110, and a bead glass 112 for supporting the grid electrodes. The grid electrodes G1–G5 are disposed inside the neck portion.

The first and second electrodes G1 and G2 are formed as flat electrodes, and the third and fourth electrodes G3 and G4 are formed as cylindrical electrodes. The fourth electrode G4 is used as a focus electrode for focusing electron beams.

As shown in the FIG. 1, the SVM coil 114 is disposed corresponding to the fourth electrode G4 around the neck portion 116.

The cylindrical portion of the fourth electrode G4 is located corresponding to the inner portion of the SVM coil 114, causing the magnetic field generated by the SVM coil 114 to be blocked by the cylindrical portion of the fourth electrode G4 and an eddy current to be generated on a metal surface of the cylindrical portion. This deteriorates the magnetic field efficiency affected on the electron beams, making it difficult to precisely control the location of the electron beams.

Figure 2:
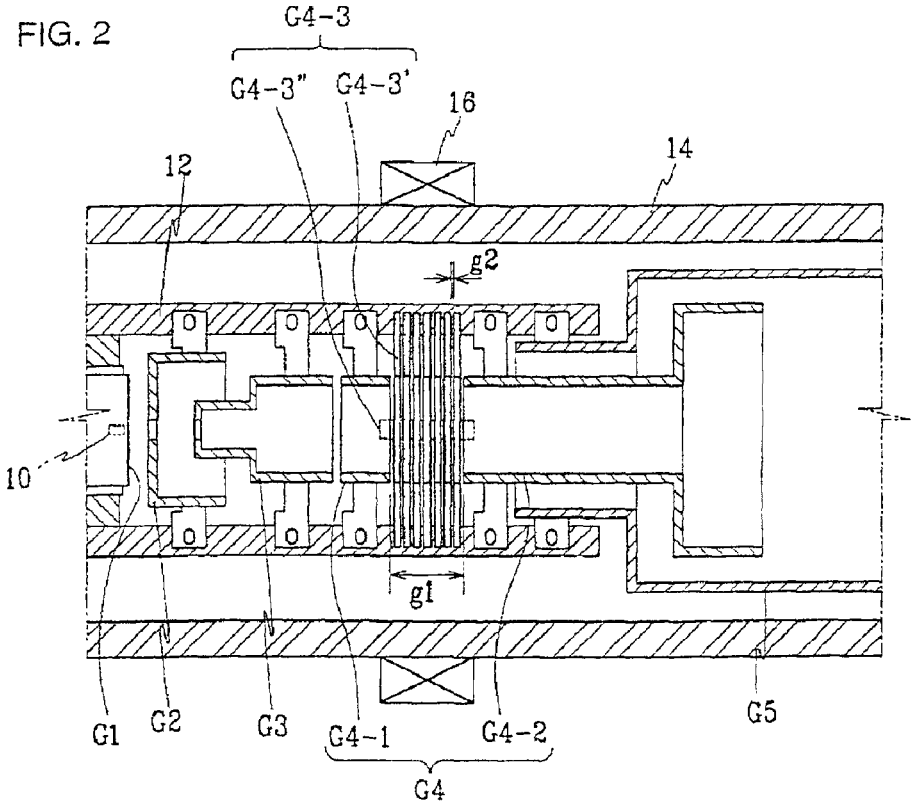
FIG. 2 is a sectional view illustrating a major part of an electron gun according to a preferred embodiment of the present invention.

FIG. 2 shows a major part of an electron gun for a CRT according to a preferred embodiment of the present invention.

The electron gun according to a preferred embodiment of the present invention includes a cathode 10 for radiating electrons, first to fifth electrodes G1–G5 for controlling the electrons radiated from the cathode 10, a bead glass 12 for aligning and fixing the electrodes G1–G5, and an SVM coil 16 disposed around a neck portion 14. The fourth electrode G4 functions as a focus electrode for focusing the electron beams.

Here, the SVM coil 16 is provided to improve the definition of borders between images by synchronizing the location of the electron beams passing the electrodes G1–G5 with image signals. The SVM includes two saddle-type coils facing each other and being interconnected in series. A brightness signal of the image signals is differentiated twice, and then input to the SVM coil.

The first electrode G1 is applied with a driving voltage lower than that applied to the cathode, the second electrode G2 is applied with a driving voltage higher than that applied to the cathode, the third and fifth electrodes G3 and G5 are applied with a driving voltage of about 32 kV (kilovolts), and the fourth electrode G4 is applied with a driving voltage of about 10 to 20 kV. The fourth electrode G4 is divided into first and second sub-electrodes G4-1 and G4-2 between which a gap g1 through which the magnetic field generated by the SVM coil 16 passes is defined.

The first and second sub-electrodes G4-1 and G4-2 are electrically interconnected by a shield electrode G4-3 so as to prevent an outer electric field from passing through the gap g1. The shield electrode G4-3 includes a plurality of disk-shaped intermediate electrodes G4-3' disposed in a space defined by the gap g1, and electrical connecting means (unit) G4-3" for electrically connecting the disk-shaped intermediate electrodes G4-3' to the first and second sub-electrodes G4-1 and G4-2.

Here, each of the disk-shaped intermediate electrodes G4-3' is preferably formed of a nonmagnetic material and the electrical connecting means G4-3" may be formed of a conductive tape.

Figure 3:
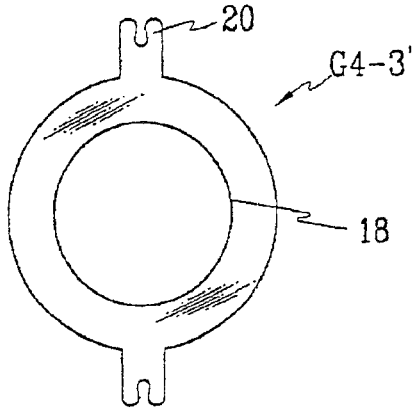
FIG. 3 is a plane view of intermediate electrodes employed by the electron gun depicted in FIG. 2.

As shown in FIG. 3, the disk-shaped intermediate electrodes G4-3' are provided at their centers with an electron beam-passing hole 18. The disk-shaped intermediate electrodes G4-3' are further provided with an embedding portion 20 which is embedded in the bead glass 12.

The distance of the gap g1 defined between the first and second sub-electrodes G4-1 and G4-2 is about 4 to 12 mm (millimeters) so that the properties of the SVM coil 16 can be improved, thereby making the magnetic field generated by the SVM coil 16 be effectively applied to the electron beams. In addition, to form an effective lens between the first sub-electrode G4-1 and the third electrode G3, the first sub-electrode G4-1 is designed having a length that is more than 0.5 times the inner diameter thereof.

At this point, the disk-shaped intermediate electrodes G4-3' disposed in the gap between the first and second sub-electrodes G4-1 and G4-2 have an identical thickness within a range of 0.5 to 1.0 mm so that they can prevent the generation of the eddy current with the magnetic field generated by the SVM coil 16. In addition, a gap g2 of about 0.5 to 1.0 mm is provided between the adjacent disk-shaped intermediate electrodes G4-3'. When the gap g2 is less than 0.5 mm, the SVM coil 16 cannot perform its function, and when it is larger than 1.0 mm, the outer electric field may be infiltrated, deteriorating the focusing operation.

The magnetic field generated by the SVM coil 16 affects the electron beams through the gap g1 between the first and second sub-electrodes G4-1 and G4-2, and actually through the gaps g2 between the disk-shaped intermediate electrodes G4-3'. At this point, the generation of the eddy current on the circumference of the disk-shaped intermediate electrodes G4-3' when the magnetic to field passes through the gaps g1 and g2 is prevented, improving the properties of the coil 16. In addition, since the shield electrode G4-3 prevents the outer electric field from infiltrating, it improves the focusing operation of the focus electrode.

Figure 4:
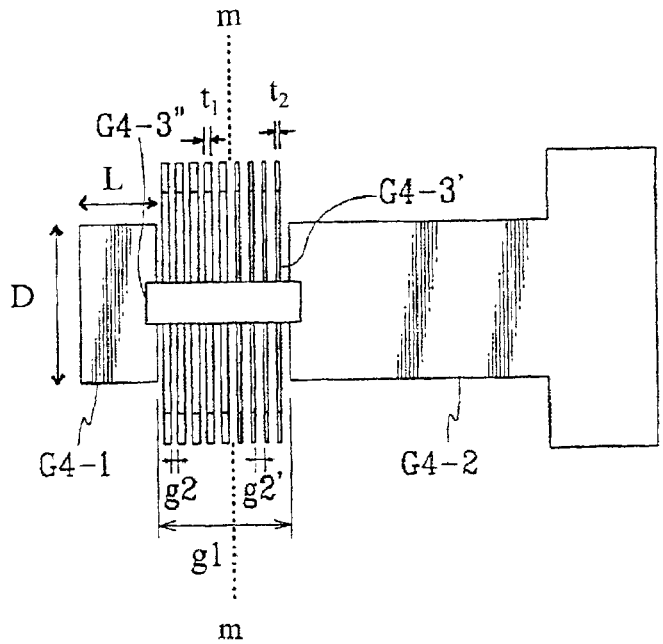
FIG. 4 is a side view illustrating a focus electrode employing a modified example of an intermediate electrode.

FIG. 4 shows a modified example of the focus electrode with an intermediate electrode.

In this modified example, the first sub-electrode G4-1 is designed having a length L of less than 0.5 times the inner diameter D thereof.

To prevent the lens operation by the third electrode G3 and the first sub-electrode G4-1 from being deteriorated by the shortened length of the first sub-electrode G4-1, as shown in FIG. 4, the thickness $t_1$ of the disk-shaped intermediate electrodes G4-3' proximal to the first sub-electrode G4-1 on the basis of the midpoint m of the gap g1 is designed to be greater than the thickness $t_2$ of the disk-shaped intermediate electrodes G4-3' proximal to the second sub-electrode G4-2 and/or the gap g2 between the disk-shaped intermediate electrodes G4-3' proximal to the first sub-electrode G4-1 is designed to be less than the gap g2' between the disk-shaped intermediate electrodes G4-3' proximal to the second sub-electrode G4-2.

At this point, the thickness ($t_1$, $t_2$) of the disk-shaped intermediate electrodes G4-3' is defined in a range (preferably, 0.5 to 1.0 mm) at which the eddy current is not generated on the surfaces of the disk-shaped intermediate electrodes G4-3', and the gap (g2, g2') between the disk-shaped intermediate electrodes G4-3' is defined in a range of 0.5 to 1.0 mm at which infiltration of the outer electric field can be prevented.

As described above, by properly setting the thickness of and the gap between the disk-shaped intermediate electrodes, the properties of the SVM coil 16 can be improved.

Figure 6:
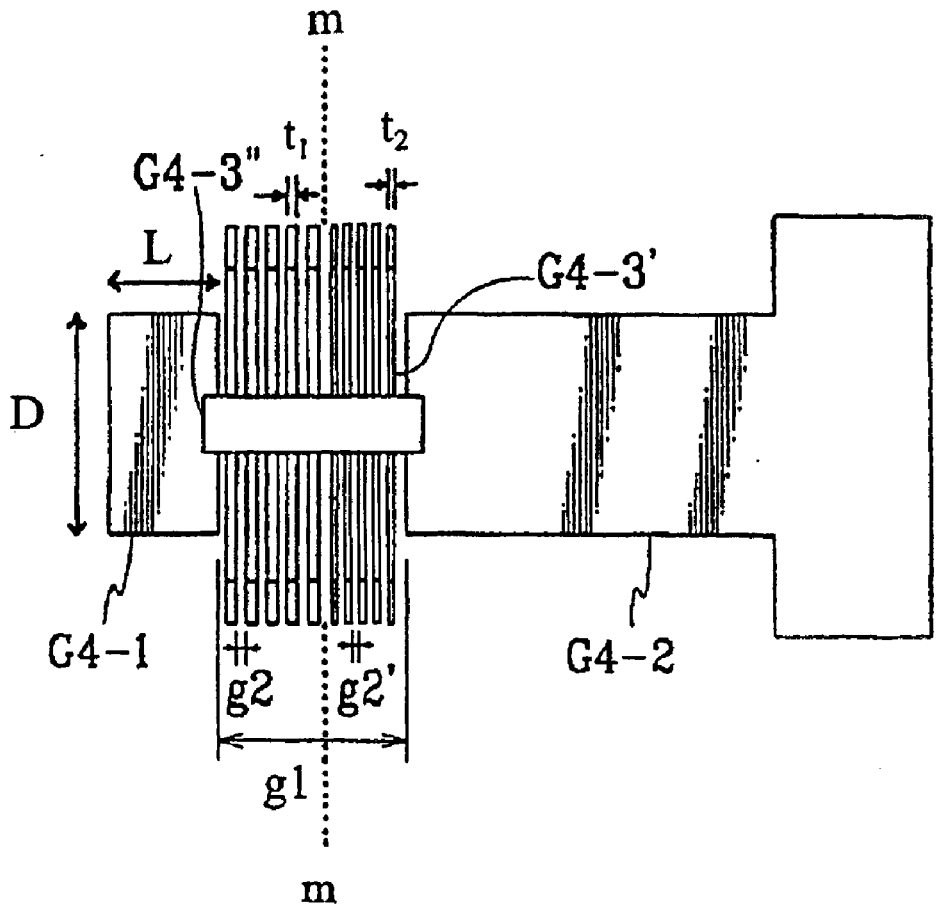
FIG. 6 is a side view illustrating a focus electrode employing a modified example of an intermediate electrode.

FIG. 6 is a side view illustrating a focus electrode employing a modified example of an intermediate electrode where the thickness $t_1$ and a gap g2 of the intermediate electrodes proximal to the first sub-electrode on the basis of a midpoint m of the gap being greater than the thickness $t_2$ and the gap g2' of the intermediate electrodes proximal to the second sub-electrode.

Figure 5:
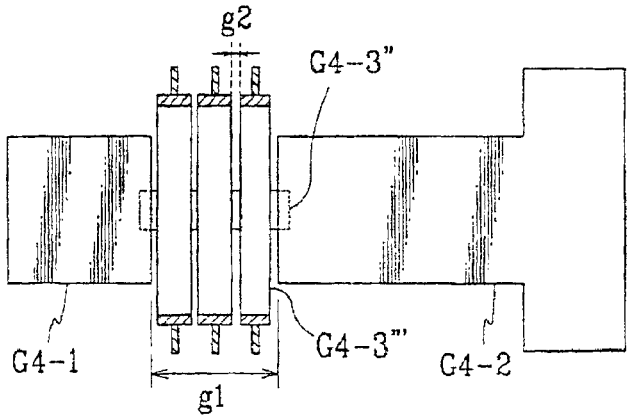
FIG. 5 is a sectional view of a focus electrode employing an intermediate electrode according to another preferred embodiment of the present invention.

FIG. 5 shows a focus electrode with an intermediate electrode according to another embodiment of the present invention.

In this embodiment, a shield electrode G4-3 includes a plurality of cylinder-shaped intermediate electrodes G4-3'" disposed in a gap g1 between sub-electrodes G4-1 and G4-2 and electrical connecting means G4-3" for electrically connecting the cylinder-shaped intermediate electrodes G4-3'" to the first and second sub-electrodes G4-1 and G4-2.

The cylinder-shaped intermediate electrodes G4-3'" are preferably made of a nonmagnetic material, and the electrical connecting means G4-3" is formed of a conductive tape.

In addition, each of the cylinder-shaped intermediate electrodes G4-3'" is provided with an embedded part 20 which is embedded in the bead glass 12.

Preferably, the gap g1 between the first and second sub-electrodes G4-1 and G4-2 is set at about 4 to 12 mm, and the length of the sub-electrode G4-1 is designed to be 0.5 times the inner diameter thereof so that the third electrode G3 and the first sub)-electrode G4-1 can form the effective lens operation.

At this point, the cylinder-shaped intermediate electrodes G4-3'" disposed between the first and second sub-electrodes G4-1 and G4-2 are spaced away from each other with a gap g2 of about 0.5 to 1.0 mm so that the outer electric field cannot be infiltrated. Preferably, the number of cylinder-shaped intermediate electrodes G4-3'" is 1 to 3.

In operation, the magnetic field generated by the SVM coil 16 affects the electron beams through the gaps g1 and g2, thereby improving the properties of the coil 16. In addition, since the shield electrode G4-3 prevents the infiltration of the outer electric field, the focusing operation can be improved.

When the length of the first sub-electrode G4-1 is designed to be less than 0.5 times the inner diameter thereof, as in the embodiment shown in FIG. 4, the space between the cylinder-shaped intermediate electrodes G4-3'" proximal to the first sub-electrode G4-1 is designed to be less than the space between the cylinder-shaped intermediate electrodes G4-3'" proximal to the second sub-electrode G4-2, thereby preventing the lens operation by the third electrode G3 and the first sub-electrode G4-1 from being deteriorated.

While this invention has been described in connection with what are presently considered to be the most practical and preferred embodiments, it is to be understood that the invention is not limited to the disclosed embodiments, but, on the contrary, is intended to cover various modifications and equivalent arrangements included within the spirit and scope of the appended claims.

What is claimed is:

1. An electron gun for a cathode ray tube, comprising:

a cathode for radiating electron beams;

a scanning velocity modulation coil for synchronizing the electron beams with an image signal;

a focus electrode including first and second sub-electrodes disposed with a gap through which a magnetic field generated by the scanning velocity modulation coil passes;

a plurality of grid electrodes with said focus electrode for controlling the electron beams radiated from said cathode;

a support for aligning and supporting said grid electrodes; and a shield electrode electrically connected to said first and second sub-electrodes to protect from infiltration of an outer electric field, said shield electrode comprising plural intermediate electrodes disposed in the gap between said first and second sub-electrodes and electrical connecting means for electrically connecting said intermediate electrodes to said first and second sub-electrodes, said intermediate electrodes being spaced away from each other and having different thickness from each other.

2. The electron gun of claim 1, further comprised of the spacing distance between said first and second sub-electrodes being about 4 to 12 millimeters.

3. The electron gun of claim 2, further comprised of each of the intermediate electrodes having a thickness of about 0.5 to 1.0 millimeter and being formed of a nonmagnetic material.

4. The electron gun of claim 3, further comprised of said first sub-electrode including a length of more than 0.5 times the inner diameter of said first sub-electrode.

5. The electron gun of claim 3, further comprised of said first sub-electrode including a length less than 0.5 times the inner diameter of said first sub-electrode.

6. The electron gun of claim 5, further comprised of the thickness and a gap of said intermediate electrodes proximal to said first sub-electrode on the basis of a midpoint of the gap being greater than the thickness and the gap of said intermediate electrodes proximal to said second sub-electrode.

7. The electron gun of claim 1, further comprised of a thickness of said intermediate electrodes proximal to said first sub-electrode on the basis of a midpoint of the gap being different than the thickness of said intermediate electrodes proximal to said second sub-electrode.

8. An electron gun for a cathode ray tube, comprising:

a cathode for radiating electron beams:

a scanning velocity modulation coil for synchronizing the electron beams with an image signal;

a focus electrode including first and second sub-electrodes disposed with a gap through which a magnetic field generated by the scanning velocity modulation coil passes;

a plurality of grid electrodes with said focus electrode for controlling the electron beams radiated from said cathode;

a support for aligning and supporting said grid electrodes; and a shield electrode electrically connected to said first and second sub-electrodes to protect from infiltration of an outer electric field, said shield electrode comprising plural intermediate electrodes disposed in the gap between said first and second sub-electrodes and electrical connecting means for electrically connecting said intermediate electrodes to said first and second sub-electrodes. said intermediate electrodes being spaced away from each other, further comprised of said intermediate electrodes being on the support at a distance within a range of about 0.5 to 1.0 millimeters between each one of said intermediate electrodes.

9. The electron gun of claim 8, further comprised of said intermediate electrodes being disk-shaped.

10. The electron gun of claim 8, further comprised of said intermediate electrodes being cylinder-shaped.

11. An electron gun for a cathode ray tube, comprising:

a cathode for radiating electron beams;

a scanning velocity modulation coil for synchronizing the electron beams with an image signal;

a focus electrode including first and second sub-electrodes disposed with a gap through which a magnetic field generated by the scanning velocity modulation coil passes;

a plurality of arid electrodes with said focus electrode for controlling the electron beams radiated from said cathode;

a support for aligning and supporting said grid electrodes; and a shield electrode electrically connected to said first and second sub-electrodes to protect from infiltration of an outer electric field, said shield electrode comprising plural intermediate electrodes disposed in the gap between said first and second sub-electrodes and electrical connecting means for electrically connecting said intermediate electrodes to said first and second sub-electrodes. said intermediate electrodes being spaced away from each other, further comprised of a thickness of said intermediate electrodes proximal to said first sub-electrode on the basis of a midpoint of the gap being greater than the thickness of said intermediate electrodes proximal to said second sub-electrode.

12. The electron gun of claim 11, further comprised of said intermediate electrodes being disk-shaped.

13. An electron gun for a cathode ray tube, comprising:

a cathode for radiating electron beams;

a scanning velocity modulation coil for synchronizing the electron beams with an image signal;

a focus electrode including first and second sub-electrodes disposed with a gap through which a magnetic field generated by the scanning velocity modulation coil gasses;

a plurality of arid electrodes with said focus electrode for controlling the electron beams radiated from said cathode;

a support for aligning and supporting said grid electrodes; and a shield electrode electrically connected to said first and second sub-electrodes to protect from infiltration of an outer electric field, said shield electrode comprising plural intermediate electrodes disposed in the gap between said first and second sub-electrodes and electrical connecting means for electrically connecting said intermediate electrodes to said first and second sub-electrodes. said intermediate electrodes being spaced away from each other.

further comprised of a gap between said intermediate electrodes proximal to said first sub-electrode being less than the gap between said intermediate electrodes proximal to said second sub-electrode.

14. The electron gun of claim 13, further comprised of said intermediate electrodes being disk-shaped.

15. An electron gun, comprising:

a focus electrode including first and second sub-electrodes disposed with a gap through which a magnetic field generated by a scanning velocity modulation coil passes; and a shield electrode electrically connected to said first and second sub-electrodes to protect from infiltration of an outer electric field, said shield electrode comprising a plurality of intermediate electrodes disposed in the gap between said first and second sub-electrodes and an electrical connecting unit electrically connecting said intermediate electrodes to said first and second sub-electrodes, said intermediate electrodes being spaced apart from each other and having different gaps of each other.

16. The electron gun of claim 15, further comprised of said first sub-electrode including a length less than 0.5 times the inner diameter of said first sub-electrode.

17. The electron gun of claim 15, further comprised of a gap between said intermediate electrodes proximal to said first sub-electrode being different than a gap between said intermediate electrodes proximal to said second sub-electrode.

18. The electron gun of claim 15, further comprised of the spacing distance between said first and second sub-electrodes being about 4 to 12 millimeters.

19. The electron gun of claim 15, further comprised of each of the intermediate electrodes having a thickness of about 0.5 to 1.0 millimeter and being formed of a nonmagnetic material.

20. An electron gun, comprising:

a focus electrode including first and second sub-electrodes disposed with a gap through which a magnetic field generated by a scanning velocity modulation coil passes; and a shield electrode electrically connected to said first and second sub-electrodes to protect from infiltration of an outer electric field, said shield electrode comprising a plurality of intermediate electrodes disposed in the gap between said first and second sub-electrodes and an electrical connecting unit electrically connecting said intermediate electrodes to said first and second sub-electrodes, said intermediate electrodes being spaced apart from each other, further comprised of a thickness of said intermediate electrodes proximal to said first sub-electrode on the basis of a midpoint of the gap being greater than the thickness of said intermediate electrodes proximal to said second sub-electrode.

21. The electron gun of claim 20, further comprised of said intermediate electrodes being disk-shaped.

22. The electron gun of claim 20, further comprised of said intermediate electrodes being cylinder-shaped.

* * * * *